US007473212B2

(12) United States Patent
Simmons

(10) Patent No.: US 7,473,212 B2
(45) Date of Patent: Jan. 6, 2009

(54) APPARATUS FOR LOWER BACK EXERCISE

(76) Inventor: Louis J. Simmons, 3884 Larchmere Dr., Grove City, OH (US) 43123

( * ) Notice: Subject to any disclaimer, the term of this patent is extended or adjusted under 35 U.S.C. 154(b) by 0 days.

(21) Appl. No.: 11/218,369

(22) Filed: Sep. 2, 2005

(65) Prior Publication Data

US 2007/0054787 A1 Mar. 8, 2007

(51) Int. Cl.
*A63B 21/08* (2006.01)
*A63B 23/02* (2006.01)

(52) U.S. Cl. ..... 482/97; 482/95; 482/137; 482/142; 482/145; 482/907

(58) Field of Classification Search ..... 482/100, 482/92–98, 137, 142, 145, 907, 104, 110; D21/676

See application file for complete search history.

(56) References Cited

U.S. PATENT DOCUMENTS 2,855,199 A * 10/1958 Noland et al. ..... 482/97
3,074,716 A 1/1963 Mitchel et al.
3,120,954 A 2/1964 Apostol
3,850,430 A 11/1974 Hamilton
3,976,058 A 8/1976 Tidwell
4,292,962 A 10/1981 Krause
4,509,746 A * 4/1985 Mask ..... 482/137
4,546,968 A * 10/1985 Silberman ..... 482/97
4,749,190 A * 6/1988 Jennings ..... 482/104
4,813,666 A * 3/1989 Costilow et al. ..... 482/80
4,854,578 A * 8/1989 Fulks ..... 482/100
4,883,269 A * 11/1989 Shaver ..... 482/97
4,923,195 A * 5/1990 Calderone ..... 482/97
5,035,234 A 7/1991 Forsythe
5,066,003 A 11/1991 Jones
5,163,890 A * 11/1992 Perry, Jr. ..... 482/142
5,184,991 A * 2/1993 Brangi ..... 482/97
5,356,359 A * 10/1994 Simmons ..... 482/97
5,372,556 A * 12/1994 Ropp ..... 482/41
5,429,570 A * 7/1995 Beyer ..... 482/104
5,554,084 A * 9/1996 Jones ..... 482/97
5,554,090 A * 9/1996 Jones ..... 482/97
5,562,579 A * 10/1996 Sheikowitz ..... 482/138

(Continued)

FOREIGN PATENT DOCUMENTS

AU 200197419 A * 6/2002

(Continued)

*Primary Examiner*—Loan H Thanh
*Assistant Examiner*—Victor K Hwang
(74) *Attorney, Agent, or Firm*—John A. Thomas

(57) ABSTRACT

An apparatus for lower back exercise comprises a support structure and a body support platform supported by the support structure. A pendulum having three segments is connected to the support structure. The pendulum has a first segment; pivotably connected to the support structure; a second segment that proceeds from the first segment at a first angle; and a third segment that proceeds from the second segment at a second angle, so that the center of mass of the pendulum is offset from the vertical. Weights may be connected to the third segment of the pendulum. There is a means, such as straps, connected to the pendulum, for engaging the legs of a user. The user exerts force with his legs to move the pendulum through a range of motion greater than 90 degrees.

15 Claims, 3 Drawing Sheets

U.S. PATENT DOCUMENTS

| | | | | |
|---|---|---|---|---|
| 5,669,860 | A | 9/1997 | Reyes | |
| 5,788,615 | A * | 8/1998 | Jones | 482/97 |
| 5,897,473 | A * | 4/1999 | Koenig | 482/97 |
| 5,941,804 | A * | 8/1999 | Johnston et al. | 482/97 |
| 6,350,219 | B1 * | 2/2002 | Hobson | 482/97 |
| 6,491,607 | B2 | 12/2002 | Simmons et al. | |
| 6,605,024 | B2 * | 8/2003 | Stearns | 482/142 |
| 6,811,521 | B1 * | 11/2004 | Musso | 482/104 |
| 7,238,148 | B2 * | 7/2007 | Simmons | 482/130 |
| 7,435,207 | B2 * | 10/2008 | Cook et al. | 482/142 |
| 2005/0009675 | A1 * | 1/2005 | Van Den Heever | 482/131 |
| 2005/0124470 | A1 * | 6/2005 | Schopf | 482/100 |
| 2006/0100070 | A1 * | 5/2006 | Abdo | 482/121 |

FOREIGN PATENT DOCUMENTS

| | | | |
|---|---|---|---|
| FR | 2703595 | A1 * | 10/1994 |

* cited by examiner

APPARATUS FOR LOWER BACK EXERCISE

TECHNICAL FIELD

The disclosure relates to an improved apparatus and method for lower back exercise and an apparatus for exercising the lower back.

BACKGROUND

Back muscle and cartilage injuries, especially in the lower lumbar region of the back are relatively common. Such injuries are especially common in individuals who, for one reason or another, have failed to maintain the conditioning and tone of the muscles that support the lower back. These muscles, the spinal erectors and hip flexor must be maintained in reasonable condition if such muscle and cartilage injuries are to be protected against.

Additionally, once injury has occurred, healing can be promoted by increasing the flow of blood to the injured muscles and the areas surrounding the injury. Unfortunately, the number and density of blood vessels in the lower back area is relatively low. However, exercise is believed by many to stimulate increased blood flow. A drawback to most forms of exercise is the risk or tendency of hyperextension of the already injured muscles thereby aggravating the injury rather than promoting healing of the muscles, cartilage and surrounding tissues.

None of the previous attempts to design exercise machines for the back have met the needs of individuals who have already sustained lower back injuries or whose lower back areas are too out-of-condition to be able to withstand rigorous exercise. In order for exercise to be of value, it must progressively increase in intensity. A common method of increasing the intensity of an exercise is through the use of increased resistance from static weight additions. However, adding weight to an exercise can increase the hyperextension of lower back muscles. Therefore, weight training is not generally recommended for those suffering from lower back muscle, tissue and cartilage injuries. Also, prior-art systems do not provide a large enough range of motion to adequately load the low-back spinal erectors while simultaneously providing greater traction to the lumbar region.

There is a need for a method of exercise and an exercise apparatus that avoids hyperextension of lower back muscles while providing for conditioning and muscle tone, and which can increase local blood circulation to injured muscles and tissues in the lower back. There is also a need for an exercise machine that will provide a sufficient range of motion to adequately load the low-back spinal erectors while simultaneously providing greater traction to the lumbar region.

SUMMARY

I disclose an apparatus and method for exercising the lower back muscles, so that the muscles can be vigorously exercised without the risk of hyperextension and injury or aggravation of existing injury. Its range of motion is 45 degrees greater for eccentric and 50 degrees greater for concentric muscle work than prior-art solutions. (An "eccentric contraction" occurs when a muscle is forced to lengthen due to the high external load, although it may be fully activated. Contractions that permit the muscle to shorten are referred to as "concentric contractions.") By this larger range of motion, the apparatus can build the muscles of the low back spinal erectors, while simultaneously providing greater traction on the lumbar region. It is difficult to activate epaxial muscles, such as the interspinals connecting adjacent spinous processes, or the intertransversalis connecting adjacent transverse processes of the vertebrae, by doing ordinary physical exercises. By gaining the extra range of eccentric and concentric motion cited, this can be accomplished. The apparatus and method increase intra-abdominal pressure and decrease the load on the intervertebral disks.

The apparatus provides a support structure and a body support platform supported by the support structure. A pendulum having three segments is connected to the support structure. The pendulum has a first segment; pivotably connected to the support structure; a second segment that proceeds from the first segment at a first angle; and a third segment that proceeds from the second segment at a second angle, so that the center of mass of the pendulum is offset from the vertical. Weights may be connected to the third segment of the pendulum. There is a means, such as straps, connected to the pendulum, for engaging the legs of a user. The user exerts force with his legs to move the pendulum through a range of motion greater than 90 degrees.

I also disclose a method using the apparatus for exercising the lower back and upper legs, comprising the steps of:

disposing a user anterior side down on the body support platform so that the stomach and chest areas are supported and maintained above the ground and such that the legs are not supported by the platform but hang freely and vertically down from the edge of the platform;

lifting the legs of the user to an approximately horizontal position against the resistance of the pendulum wherein the force of lifting is provided by the contraction of the gluteus maximus, and the erector and flexor muscles of the lower back; and, lowering the legs through the starting position, all in a total motion substantially greater than 90 degrees, repeating the lifting and lowering steps to form an exercise regimen.

DETAILED DESCRIPTION

Figure 1:
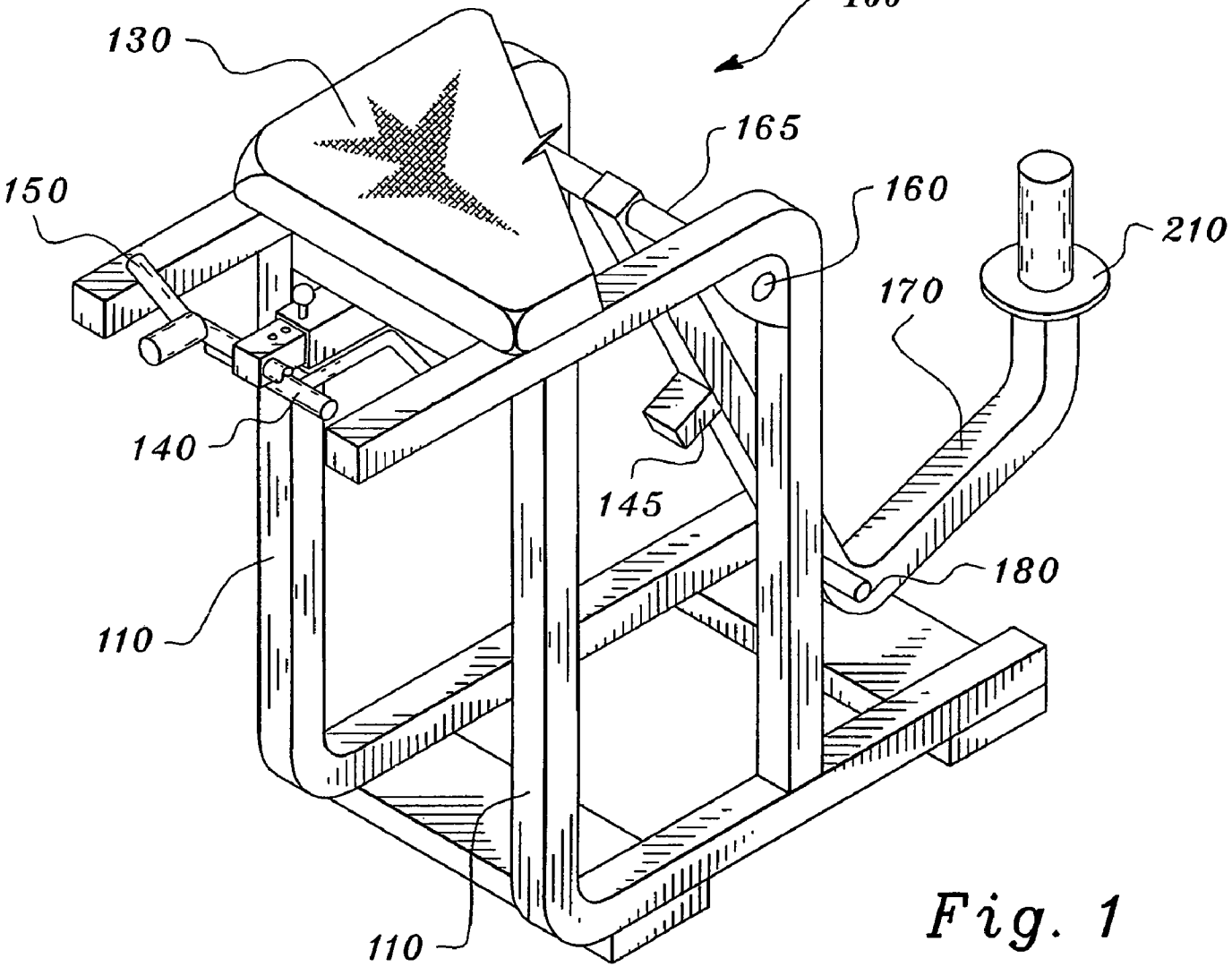
FIG. 1 is a perspective view of the preferred embodiment.

The first preferred embodiment of the exercise apparatus (100) is illustrated by FIGS. 1-5. A support frame (110) supports the body of an athlete (shown in dotted outline) and the moving parts of the apparatus. The frame (110) should preferably be made of structural steel sections to provide a very rigid support structure. Conventional bracing may be added, if needed. Movement of the support structure during the exercise is both dangerous and can cause unneeded anxiety in the person who is performing the exercise. The frame (110) preferably rests on supports (120), raising it slightly off the floor. There is a body support (130) on top of the frame (110). The body support is preferably padded.

Attached to the frame (110) adjacent to the body support (130) is a handle bar (150), preferably extendable and held in the desired place with a pin (155). For safety and ease of mounting the exercise apparatus (100), there is a support bar (140). The support bar (140) engages a catch (145) fixed to the pendulum (170). Thus the pendulum (170) is prevented from swinging forward (toward the handle bar (150)) as the user mounts the exercise apparatus (100). After the user has mounted, he can pull the support bar (140) forward, thus releasing the pendulum (170).

In FIGS. 2-5, "forward" is toward the left; that is toward the head of the user. "Rearward" is in the opposite direction.

A pivot bar (160), which may be located at any location below the body support platform, rotatably retains the pendulum (170). However, for optimal implementation of the exercise method the pivot bar (160) should be located at a point below the location of the waist of the person using the apparatus (100) and at a vertical position near the body support platform (130). In this way, the length of pendulum (170) can be maximized.

Pendulum (170) is rotatably retained on the pivot bar (160) by one or more bearings (165), which may be a mere hole in pendulum (170), or preferably one or more ball bearings (165) fitted to the pivot bar (160). The pendulum (170) is then freely pivotable about the pivot bar (160) from one of its ends, as shown, in a substantially vertical plane.

Figure 2:
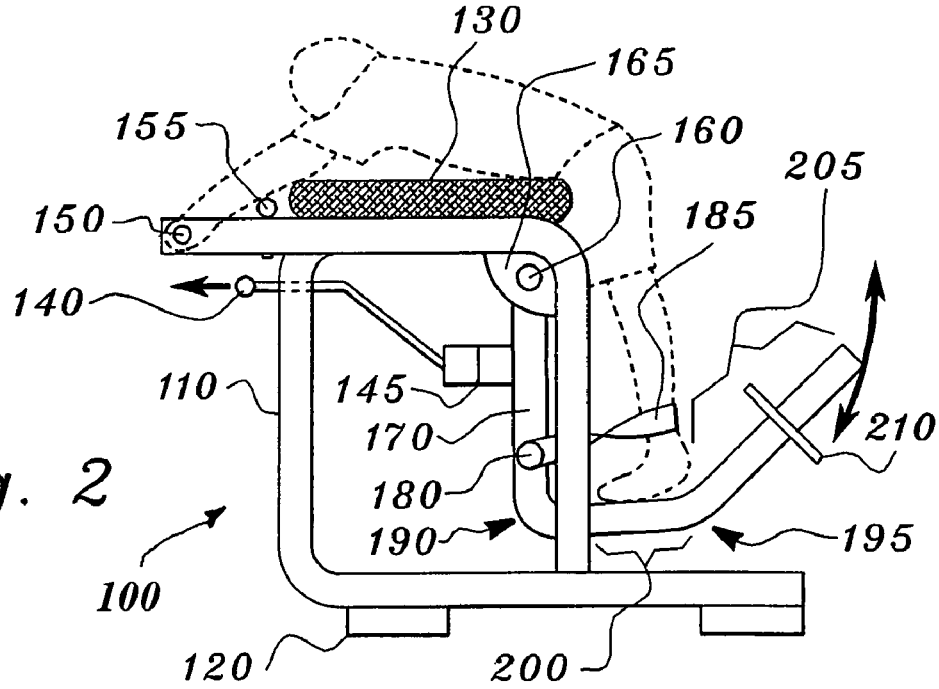
FIG. 2 is a side elevation of the preferred embodiment with a user shown in the proper position to start the exercise.
Figure 3:
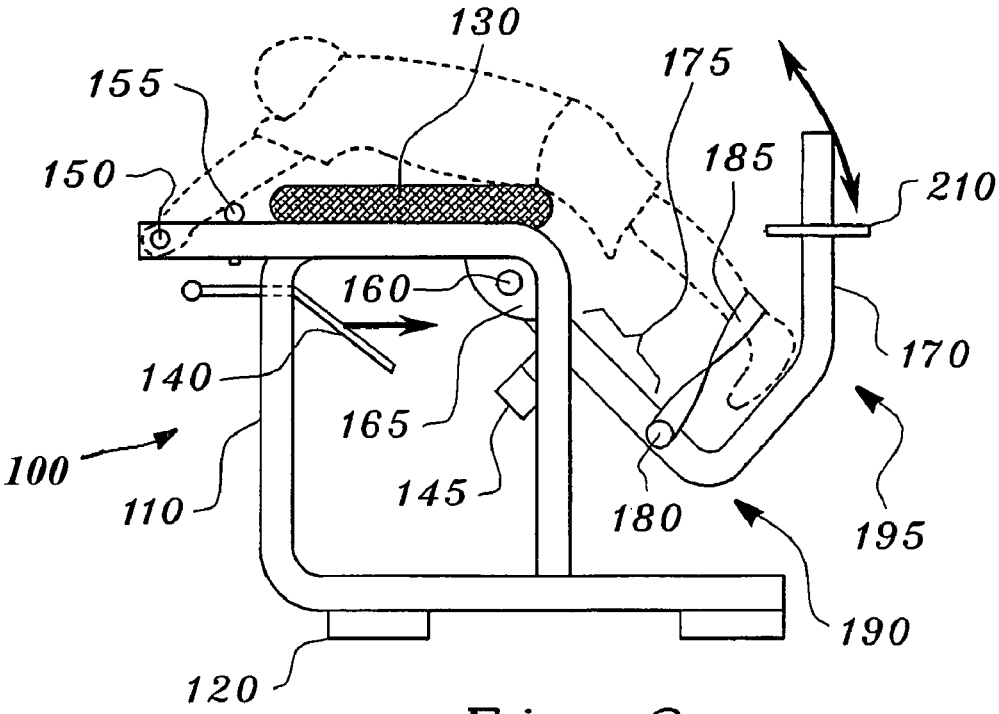
FIG. 3 is a side elevation of the preferred embodiment with a user shown performing the primary action of the exercise method.

The pendulum has three segments. Located on the first segment (175) of the pendulum (170), shown as vertical in FIG. 2, is a means for engaging a user's legs. Preferably, this is a cross bar (180), to which straps (185) may be fastened, so that the user's ankles can be held by the straps (185). Other such means could be chains, ropes, foot pedals, or cups for holding the heels, or some combination.

As shown in the figures, the pendulum (170) has a first bend angle (190) of approximately 90 degrees. The pendulum (170) has a second bend angle (195) of approximately 45 degrees. These angles define a first segment (175) and a second segment (200) of the pendulum (170). The third segment (205) proceeds from the second bend. A stop (210) is provided on the third segment for attaching conventional circular weights (not shown). These weights (and the weight of the pendulum (170) itself) provide the resistance against which the exercise is performed.

Because of the configuration of the pendulum (170) into the three segments (175, 200, and 205), its center of mass is offset from the vertical in a rearward direction. This means that the first segment (175) of the pendulum (170) will be urged forward of the vertical when the support bar (140) is released from the catch (145). The forward force thus exerted provides greater extension of the lumbar muscles. Also, this configuration allows a maximum range of motion of the pendulum greater than 90 degrees.

FIGS. 2, 3, 4, and 5 show the entire range of the preferred exercise method. At FIG. 2, the user performing the exercise is shown in the proper position (face down or equivalently, anterior side down) to begin the exercise, just before releasing the pendulum (170) by means of the support bar (140) and catch (145). The torso to the waist is fully supported by body support platform (130). The user's ankles or lower legs are shown passing through the straps (180) connected to the cross bar (175). Preferably, the exercise is performed with the ankles passing through the straps (180). The pendulum is at rest in the vertical position straight below the waist of the user.

Figure 4:
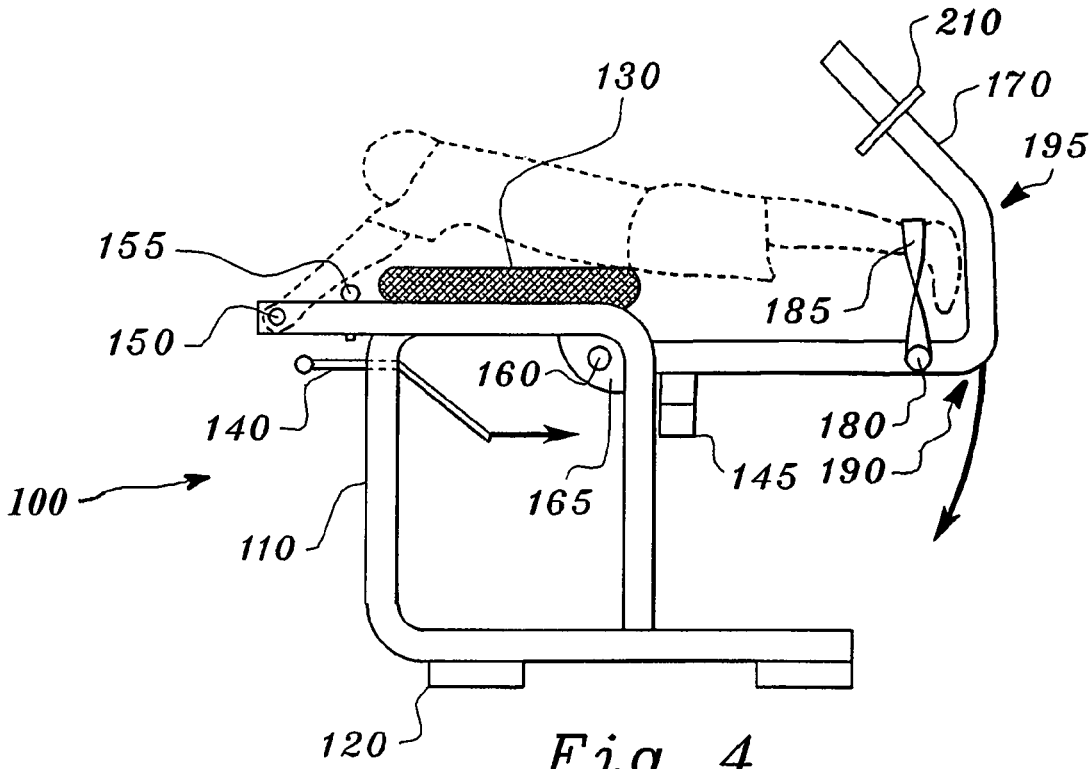
FIG. 4 is a side elevation of the preferred embodiment with a user shown in the maximum extension of the exercise method.
Figure 5:
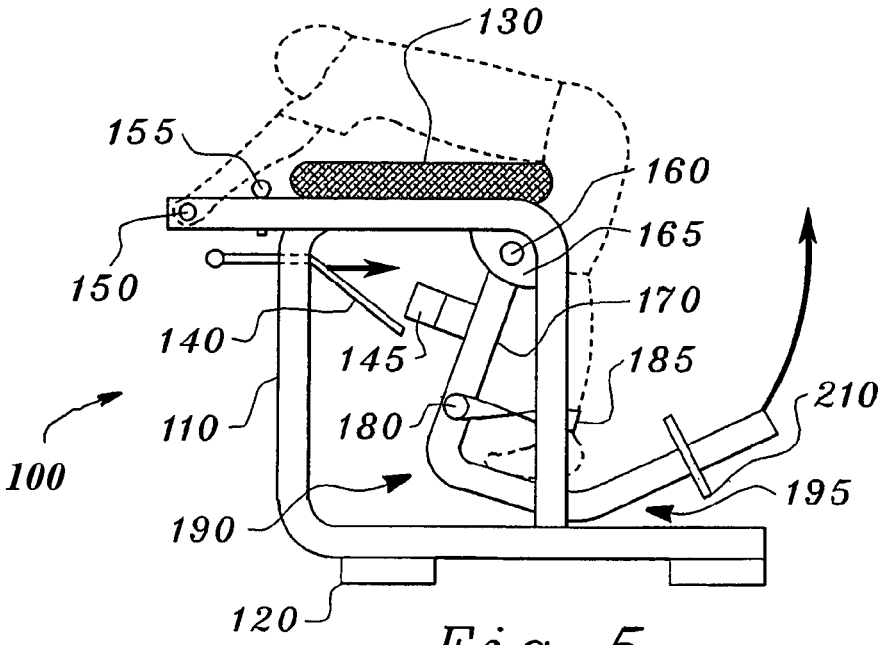
FIG. 5 is a side elevation of the preferred embodiment with a user shown performing the recovery action of the exercise method.

After the support bar (140) is released, the pendulum (170) will swing forward to approximately the position shown in FIG. 5, pulling the legs of the user forward of the vertical. The exercise begins by the user contracting the muscles of the lower back (i.e., spinal erectors and hip flexors) and the gluteus maximus. The legs working against the variable combined weight of pendulum (170) and weights attached to the pendulum (170) are moved through the intermediate position shown in FIG. 3 to, at the extreme, the horizontal position as shown in FIG. 4.

The user then lowers the legs, not by simply relaxing the muscles, but by lowering the legs using all the muscle groups of the upper legs and lower back. The legs are fully lowered to at least the vertical and then are pushed by the weight of the pendulum (170) forward past the vertical as shown in FIG. 5. Thus, the total range of motion of the legs is greater than 90 degrees. After the user has resisted the movement of his legs as far past the vertical as he can, the exercise begins again by contracting the muscles and pushing the legs back to the horizontal (FIG. 4). The exercise is then repeated the number of times desired by the user.

The exercise is best performed as a smooth continuous action through the iterations. At all points in the exercise, the legs and correspondingly the affected muscles only push and are never pulled from one station to the next. The result is that hyperextension of muscles is avoided and the injured muscles of the lower back are permitted to receive an increased flow of blood. Additionally, for a user with an otherwise healthy lower back, the exercise builds up those lower back muscles thus avoiding future injury.

Increasing lower back strength is also critical to power lifting. The most common injuries to power lifters are those of the lower back. However, by regularly using the exercise disclosed, users who lift very heavy weights for sport or in competition, also known as power lifters, can train to greater weight levels while avoiding lower back injuries which are not only counter productive to a proper training program due to lost training time, but also could lead to permanent lower back injuries that are also common among power lifters.

Since those skilled in the art can modify the specific embodiments described above, I intend that the claims be interpreted to cover such modifications and equivalents.

I claim:

1. An apparatus for lower back exercise, the apparatus comprising:

a support structure, the support structure further comprising a handle bar supported by the support structure;

a pendulum, the pendulum having a forward direction of swing toward the handle bar, and a rearward direction of swing away from the handle bar;

the pendulum further comprising:

a first segment; the first segment pivotably connected to the support structure, so that the pendulum is free to swing forward and rearward of a vertical direction beneath the pivotable connection under the influence of gravity;

a second segment; the second segment proceeding rearward from the first segment at a first angle;

a third segment; the third segment proceeding rearward from the second segment at a second angle;

the third segment having an end free for receiving weights;

the end free for receiving weights being upwardly-directed when the first segment is horizontal and when the first segment is vertical;

where the first, second, and third segments lie in the same plane; and, a means, connected to the pendulum, for engaging the legs of a user.

2. The apparatus for lower back exercise of claim 1 where the third segment of the pendulum has a stop for supporting one or more weights.

3. The apparatus for lower back exercise of claim 1 where the means for engaging the legs of a user comprises a strap.

4. The apparatus of claim 1 where the means for engaging the legs of a user comprises a cross bar connected to the first segment of the pendulum.

5. The apparatus for lower back exercise of claim 1 where the first angle is approximately 90 degrees.

6. The apparatus for lower back exercise of claim 1 where the second angle is approximately 45 degrees.

7. The apparatus for lower back exercise of claim 1 further comprising:

a catch; the catch attached to the first segment of the pendulum;

a support bar; the support bar slidably connected to the support structure; the support bar removably engaging the catch, so that the pendulum is prevented from moving when the support bar and catch are engaged.

8. An apparatus for lower back exercise, the apparatus comprising:

a support structure, the support structure further comprising a handle bar supported by the support structure;

a pivot bar pivotably connected to the support structure;

a pendulum, the pendulum having a forward direction of swing toward the handle bar, and a rearward direction of swing away from the handle bar;

the pendulum further connected perpendicularly to the pivot bar, so that the pendulum is free to swing forward and rearward beneath the pivotable connection under the influence of gravity;

a catch; the catch attached to the pendulum;

a support bar; the support bar slidably connected to the support structure;

the support bar removably engaging the catch, so that the pendulum is prevented from moving forward but not rearward when the support bar and catch are engaged;

the pendulum configured so that the center of mass of the pendulum is offset rearward in the plane of its swing from the vertical perpendicular to the pivot bar when the pendulum is prevented from moving; and, a means, connected to the pendulum, for engaging the legs of a user.

9. The apparatus for lower back exercise of claim 8 where the pendulum has a stop for supporting one or more weights.

10. The apparatus for lower back exercise of claim 8 where the means for engaging the legs of a user comprises a strap.

11. The apparatus of claim 10 where the means for engaging the legs of a user comprises a cross bar connected to the pendulum.

12. The apparatus for lower back exercise of claim 8 where the pendulum further comprises:

a first segment; the first segment connected to the pivot bar;

a second segment; the second segment proceeding from the first segment at a first angle; and, a third segment; the third segment proceeding from the second segment at a second angle.

13. The apparatus for lower back exercise of claim 12 where the first angle is approximately 90 degrees.

14. The apparatus for lower back exercise of claim 12 where the second angle is approximately 45 degrees.

15. An apparatus for lower back exercise, the apparatus comprising:

a support structure, the support structure further comprising a handle bar supported by the support structure;

a pendulum, the pendulum having a forward direction of swing toward the handle bar, and a rearward direction of swing away from the handle bar;

the pendulum further comprising:

a first segment; the first segment pivotably connected to the support structure, so that the pendulum is free to swing forward and rearward of a vertical direction beneath the pivotable connection under the influence of gravity;

a second segment; the second segment proceeding rearward from the first segment at an angle of approximately 90 degrees;

a third segment; the third segment proceeding rearward from the second segment at an angle of approximately 45 degrees; the third segment having an end free for receiving weights;

the end free for receiving weights being upwardly-directed when the first segment is horizontal and when the first segment is vertical; and, a cross bar connected to the first segment of the pendulum;

at least one strap attached to the cross bar for engaging the legs of a user;

a stop connected to the third segment of the pendulum for supporting one or more weights;

a catch; the catch attached to the first segment of the pendulum;

a support bar; the support bar slidably connected to the support structure; the support bar removably engaging the catch, so that the pendulum is prevented from moving forward but not rearward when the support bar and catch are engaged; and, a handle bar connected to the support structure, for grasping by the user.

* * * * *